US005903209A

United States Patent [19]

Stepniak

[11] Patent Number: 5,903,209

[45] Date of Patent: May 11, 1999

[54] ENCAPSULATED FUSE WITH CORONA SHIELD

[75] Inventor: Frank Stepniak, Andover, N.J.

[73] Assignee: Thomas & Betts International, Inc., Sparks, Nev.

[21] Appl. No.: 09/130,860

[22] Filed: Aug. 7, 1998

[51] Int. Cl.[6] ..... H01H 85/042; H01H 85/165; H01H 85/02

[52] U.S. Cl. ..... 337/224; 337/223; 337/199; 337/222

[58] Field of Search ..... 337/227, 228, 337/222, 223, 224, 186, 187, 199

[56] References Cited

U.S. PATENT DOCUMENTS

| | | | |
|---|---|---|---|
| 1,930,804 | 10/1933 | Hart | 337/224 |
| 1,954,037 | 4/1934 | Bowie | 337/224 |
| 2,877,322 | 3/1959 | Harner . | |
| 3,015,008 | 12/1961 | Chabala et al. . | |
| 3,559,141 | 1/1971 | Hardy | 337/224 |
| 3,578,896 | 5/1971 | Lynch | 174/84 R |
| 3,684,995 | 8/1972 | Horton, III . | |
| 3,727,108 | 4/1973 | Westrom | 317/68 |
| 3,781,745 | 12/1973 | Vadnagara | 337/199 |
| 3,783,181 | 1/1974 | Martincic et al. . | |
| 3,818,407 | 6/1974 | Edgerton | 337/199 |
| 3,946,351 | 3/1976 | Bronikowski et al. | 337/224 |
| 4,059,816 | 11/1977 | Bonecutter et al. . | |
| 4,060,785 | 11/1977 | Hanke et al. | 337/201 |
| 4,136,339 | 1/1979 | Kuhn . | |
| 4,419,651 | 12/1983 | Leach . | |

*Primary Examiner*—Leo P. Picard
*Assistant Examiner*—Anatoly Vortman
*Attorney, Agent, or Firm*—Hoffmann & Baron, LLP

[57] ABSTRACT

An encapsulated fuse assembly with a corona shield for use in high voltage underground power distribution systems. The fuse assembly includes a fuse encapsulated within an insulative outer housing. The outer surface of the fuse is coated with an electrically conductive material which is in electrical connection with one of the fuse terminals and extends along the outer surface of the fuse body to a point intermediate the other terminal leaving a portion of the fuse body not coated with the conductive material. Preferably, at least the terminal of the fuse not in contact with the conductive material is enveloped by an electrically conductive insert disposed within the insulative outer housing which along with the conductive coating establish an effective corona shield around the fuse without providing an alternate electrical circuit between the fuse terminals. The fuse assembly may include a fuse spacer which provides an electrical extension to the fuse so that different size fuses may be utilized within a standard size housing.

22 Claims, 5 Drawing Sheets

ENCAPSULATED FUSE WITH CORONA SHIELD

BACKGROUND OF THE INVENTION

1. Field of the Invention

The present invention relates to electrical fuses for high voltage underground distribution systems, and more particularly relates to a novel encapsulated fuse assembly which provides an effective corona shield.

2. Description of the Prior Art

It is desirable to provide underground power distribution system components with fuse protection to prevent damage to such components when current surges occur on the system. However, it has been found that underground power distribution systems produce severe corona problems when fuses are used in such systems.

Referring to FIG. 1, a conventional fuse assembly 100 is provided with an insulative housing 101 and an electrically conductive ground shield 102 on its outer surface which is in contact with the earth in which it is buried. As a result, steep voltage gradients across the insulating material of the fuse assembly are formed. The high system voltages present in the fuse 103 are separated from the ground shield 102 by a relatively thin insulating material. Under these conditions there is a tendency for the fuse to become electrically stressed and corona to discharge or arc from the fuse elements. This results in the formation of nitrous oxides which attack the metal components of the fuse. After the fuse has been subjected to such action for a long period of time, it may become severely corroded and the proper operation of the fuse under short circuit conditions may be seriously impaired.

Accordingly, it is desirable to provide fuses with a corona shield to reduce electrical stress and prevent arcing. Such shields operate to distribute the electrical stress across the shield and around the fuse. Thus, voltage gradients along the fuse elements are reduced and arcing is prevented. Naturally, it is important that the shield not provide an alternate electrical path between the fuse terminals when the fuse is open.

Devices to prevent corona discharge from a fuse are known. For example, U.S. Pat. No. 3,946,351 to Bronikowski et al. discloses a shielded fuse assembly comprising two housing halves which are joined to encapsulate an electrical fuse. A corona shield is imbedded within each housing half and is in electrical contact with a terminal of the fuse. A gasket is provided between the halves to prevent electrical contact between the shields.

Similarly, U.S. Pat. No. 3,818,407 to Edgerton discloses a fuse enclosure including first and second conductive shield members. Each shield member extends longitudinally from one terminal of the enclosed fuse toward the other. The conductive shield members envelop the fuse and overlap each other but do not make contact. A similar conventional shielding arrangement is shown in FIG. 1. Disposed within the insulative housing 101 are separately molded conductive members 104 and 105, each being in electrical contact with an adjacent fuse terminal 106. The conductive members 104 and 105 surround the fuse 103 but are arranged within the housing 101 such that the conductive members do not contact each other. The resulting gap 107 prevents the flow of current between the fuse terminals through the conductive members.

These and other conventional shielding arrangements involve adding one or more separate shielding components to the fuse assembly. This results in relatively high manufacturing costs and an increase in the overall size of the fuse assembly. Accordingly, there is a need for an encapsulated fuse assembly having a corona shield which is relatively inexpensive to manufacture and at the same time conveniently compact to allow its use in the relatively confined passageways available for mounting such housings in underground power distribution systems.

OBJECTS AND SUMMARY OF THE INVENTION

It is an object of the present invention to provide an encapsulated fuse assembly having an effective corona shield enveloping the fuse but not providing an alternate electrical path between the fuse terminals.

It is a further object of the present invention to provide an encapsulated fuse assembly having a corona shield which is smaller and less expensive to manufacture than conventional corona shielded fuse assemblies.

It is yet another object of the present invention to provide an encapsulated fuse assembly having a corona shield that eliminates one or more separately formed conductive shield elements.

It is still another object of the present invention to provide an encapsulated fuse assembly having a corona shield with a standard size fuse housing but capable of utilizing a variety of differently sized fuses.

In accordance with one form of the present invention, the encapsulated fuse assembly with corona shield generally includes a fuse and an insulative outer housing. Applied to the outer surface of the fuse is a coating of an electrically conductive material. The coating is in electrical contact with one of the fuse terminals and extends along the outer surface of the fuse to a point near the other terminal but not being in electrical contact therewith. The coated fuse is encapsulated by an insulative outer housing which is preferably formed of three separate components: a fuse housing; and two end housings. Alternatively, the coated fuse may be encapsulated by a unitary insulative outer housing. Disposed on the exposed outer surfaces of the insulative outer housing is an electrically conductive material forming a ground shield for the fuse assembly. The insulative housing may include two electrically conductive inserts disposed therein which substantially envelop one or both terminals of the fuse. Alternatively, in the embodiment including a unitary housing, the insulative housing may include a single conductive member which substantially envelops the uncoated end portion of the fuse. The electrically conductive coating and conductive inserts and/or member provide an effective corona shield envelope about the fuse without providing an alternate electrical path between the fuse terminals.

The present invention may include any one of a variety of differently sized fuses by providing a correspondingly sized spacer. Preferably, the spacer is a solid lightweight electrically conductive terminal extension which is electrically coupled to a terminal of the selected fuse. Alternatively, the spacer may include an insulative body surrounding a conductive terminal extension coupled to the fuse terminal. In this case, the outer surface of the spacer is coated with an electrically conductive material similar to the fuse and makes electrical contact with the conductive fuse coating when the terminal extension is coupled to the fuse. The spacer and fuse as coupled are encapsulated by the fuse housing and the end housings. The conductive inserts of the insulative housing along with the conductive fuse and spacer coatings provide an effective corona shield about the fuse and terminal extension.

A preferred form of the encapsulated fuse assembly with corona shield, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
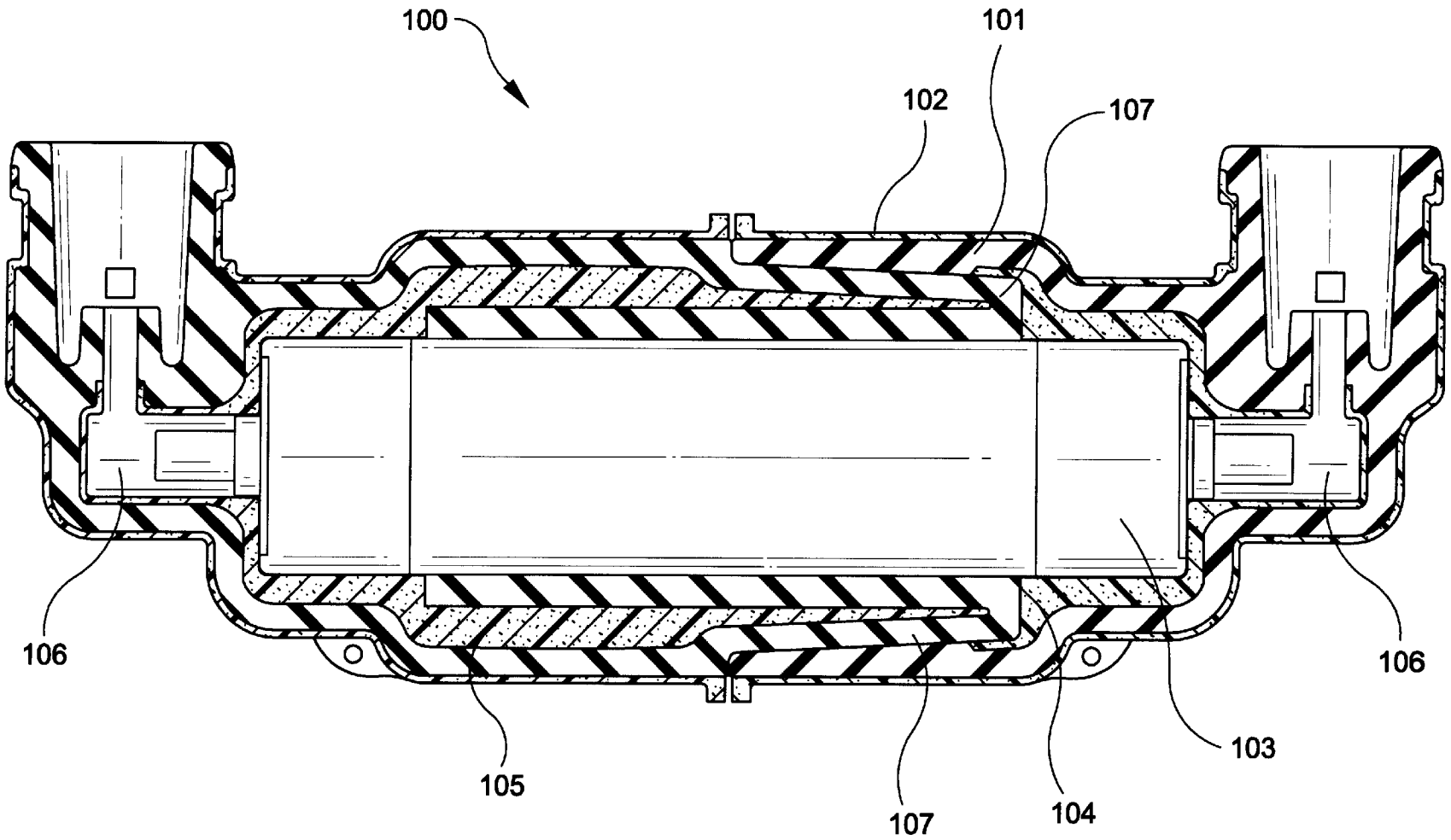
FIG-1 PRIOR ART
FIG. 1 is a cross-sectional view of a prior art encapsulated fuse assembly with a corona shield.
Figure 2:
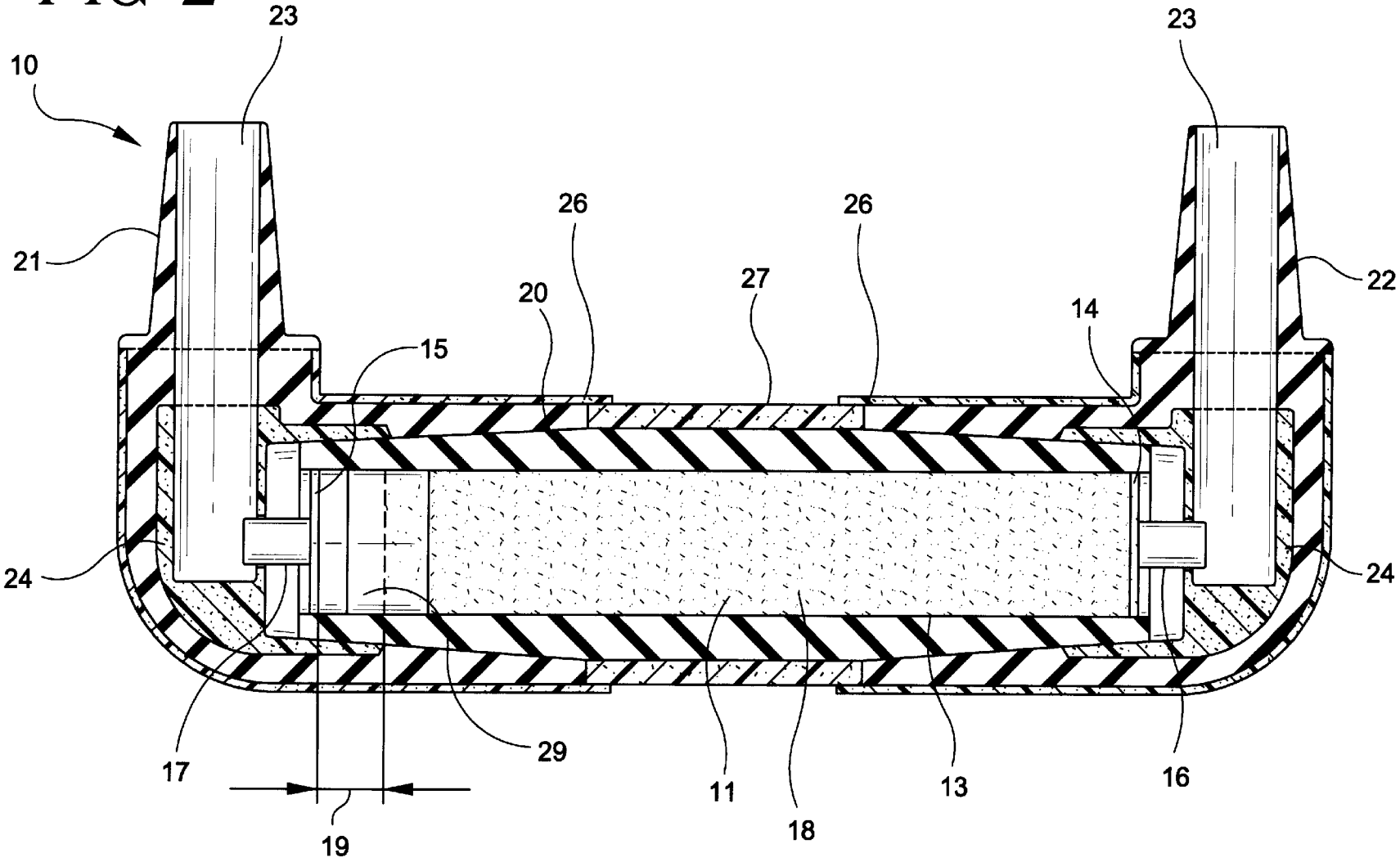
FIG. 2 is a partial cross-sectional view of the preferred embodiment of the encapsulated fuse assembly with corona shield formed in accordance with the present invention with a side view of the fuse.
Figure 3:
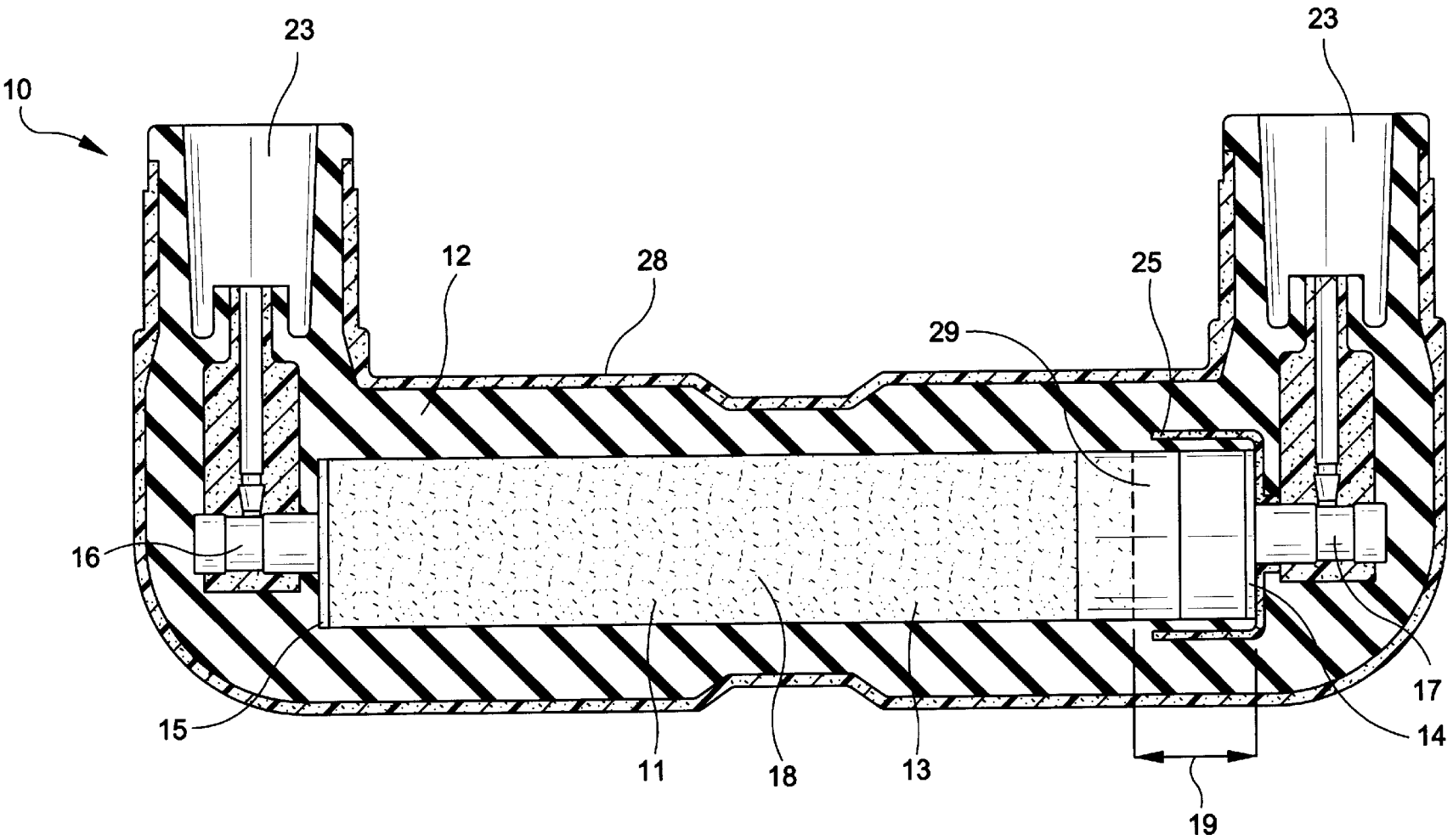
FIG. 3 is a partial cross-sectional view of an alternative embodiment of the encapsulated fuse assembly with corona shield formed in accordance with the present invention with a side view of the fuse.

Referring first to FIGS. 2 and 3, an encapsulated fuse assembly with corona shield formed in accordance with the present invention is shown. The encapsulated fuse assembly 10 generally includes a fuse 11 and an insulative outer housing 12.

Fuse 11 is generally a cartridge-type fuse well known for use in the field of high voltage distribution systems. Fuse 11 has an outer surface 13, longitudinally opposed ends 14 and 15, and terminals 16 and 17 adjacent the opposed ends. In the preferred embodiment, the outer surface 13 of the fuse 11 is coated with an electrically conductive material 18. Any suitable paint-like conductive material may be used which may be brushed or sprayed directly to the outer surface of the fuse. Alternatively, any suitable molded conductive material may be placed around the outer surface of the fuse. The outer surface 13 is coated or covered such that the electrically conductive material 18 is in electrical contact with one of the terminals 16 and extends along the length of the outer surface of the fuse to a point just intermediate the other terminal 17, leaving a portion 19 of the outer surface not coated with the conductive material.

The length of portion 19 left uncoated must be sufficient enough to withstand a voltage gradient between the terminal 17 not in contact with the conductive fuse-coating and the termination end of the conductive coating 18 when the fuse opens. A length of approximately 1.5 to 2.0 inches has been found to be the minimum length sufficient to withstand such a voltage gradient. Any smaller length may permit flashover; however, the uncoated portion 19 may be made longer depending upon the length of the conductive inserts which will be discussed below. A coating of insulating material such as insulative varnish 29 may also be applied over the termination end of the conductive coating to relieve the electrical stress occurring at the edge of the coating. Preferably, the varnish 29 is applied over an area extending over a distance of about one inch on both sides of the edge of the conductive coating.

In the preferred embodiment, the insulative outer housing consists of three separate components: a fuse housing 20 and two end housings 21 and 22, as shown in FIG. 2. A suitable material for these insulative housings is a peroxide-cured, synthetic rubber known and referred to in the industry as EPDM insulation. The fuse housing 20 may be molded directly around the conductively coated fuse 11 creating a bond therebetween to provide the desired dialectric strength. Alternatively, the fuse housing 20 may be separately molded with an axial bore for subsequent insertion of the fuse. If molded separately, an insulating varnish should be applied to the outer surface of the fuse before insertion to bond the fuse to the fuse housing providing the desired dialectric strength. In either case, the fuse housing 20 should entirely encapsulate the fuse leaving the fuse terminals 16 and 17 protruding from the ends of the fuse housing. The fuse housing 20 along with the fuse 11 thus form a unit which is replaceable should the fuse open after installation.

The end housings 21 and 22 are separately molded from a similar insulative material as the fuse housing 20 and are shaped to fit securely over the ends of the fuse housing. The end housings may be shaped as straight fittings or elbow fittings as shown in FIG. 2. The end housings 21 and 22 should also be provided with access ports 23 to provide access to the terminals 16 and 17 of the fuse for electrical connection to the voltage distribution system.

In the preferred embodiment, seated within the end housings 21 and 22 are electrically conductive inserts 24 which may be made from any suitable electrically conductive material such as conductive EPDM. Conductive inserts 24 in both end housings are desirable due to the unavoidable trapped air at the ends of the fuse 11 resulting from the assembly of separate pieces. The electrically conductive inserts 24 are formed within the end housings 21 and 22 such that when the end housings are secured to the fuse housing, the electrically conductive inserts substantially envelop and are in electrical communication with the terminals 16 and 17 of the fuse. Also, the conductive insert adjacent the uncoated fuse terminal should also substantially overlap the portion 19 of the fuse not coated with conductive material to form, along with the conductive fuse coating 18, a continuous conductive envelope fully enclosing the fuse.

Finally, disposed on the outer surface of end housings 21 and 22 are electrically conductive jackets 26. Similarly, the outer surface of fuse housing 20 not encapsulated by end housings 21 and 22 is provided with an electrically conductive sleeve 27. A suitable material for the conductive jackets 26 and conductive sleeve 27 is conductive EPDM which may be directly molded to the outer surfaces. The conductive jackets 26 of the end housings are in electrical communication with the conductive sleeve 27 to form a continuous ground shield for the encapsulated fuse assembly 10.

In an alternative embodiment, the insulative outer housing 12 is a single integral unit molded directly around the coated fuse 11, as shown in FIG. 3. The insulative outer housing 12 completely envelops the fuse 11, but is provided with access ports 23 for access to the terminals 16 and 17 of the fuse.

As illustrated in FIG. 3, the fuse assembly includes at least one electrically conductive insert 25 within the insulative housing to shield at least the uncoated portion of the fuse. Here, the conductive insert 25 may take the form of a metallic sleeve having insulative material molded around it. The electrically conductive insert 25 is disposed within the insulative housing 12 to substantially envelop and be in electrical communication with the fuse terminal 17 not in contact with the conductive fuse coating 18. Also, the conductive insert 25 should also substantially overlap the portion 19 of the fuse not coated with conductive material to form, along with the conductive fuse coating 18, a continuous conductive envelope fully enclosing the fuse.

Disposed on the outer surface of the insulative housing 12 is an electrically conductive jacket 28. As described above, the conductive jacket 28 forms a continuous ground shield for the encapsulated fuse assembly 10.

In both embodiments of the present invention, the coating of electrically conductive material 18, preferably in conjunction with the electrically conductive inserts 24 or 25, substantially envelops the fuse 11 thereby providing an effective corona shield. Also, since the conductive coating is in electrical contact with only one of the fuse terminals, the shield does not provide an alternate electrical path between the terminals when the fuse opens. This is achieved with a minimum number of shielding components which in turn reduces the size and cost of the assembly.

It is often desirable to have a standard size fuse housing in high voltage distribution systems for ease of connection to mating components. However, the size of the fuse itself may vary depending on the particular application or location within the system. The encapsulated fuse assembly formed in accordance with the present invention may be made in a standard size and can include a variety of differently sized fuses. Alternatively, the embodiment illustrated in FIG. 3 may be specifically dimensioned to house the specific size fuse to be used.

Figure 4:
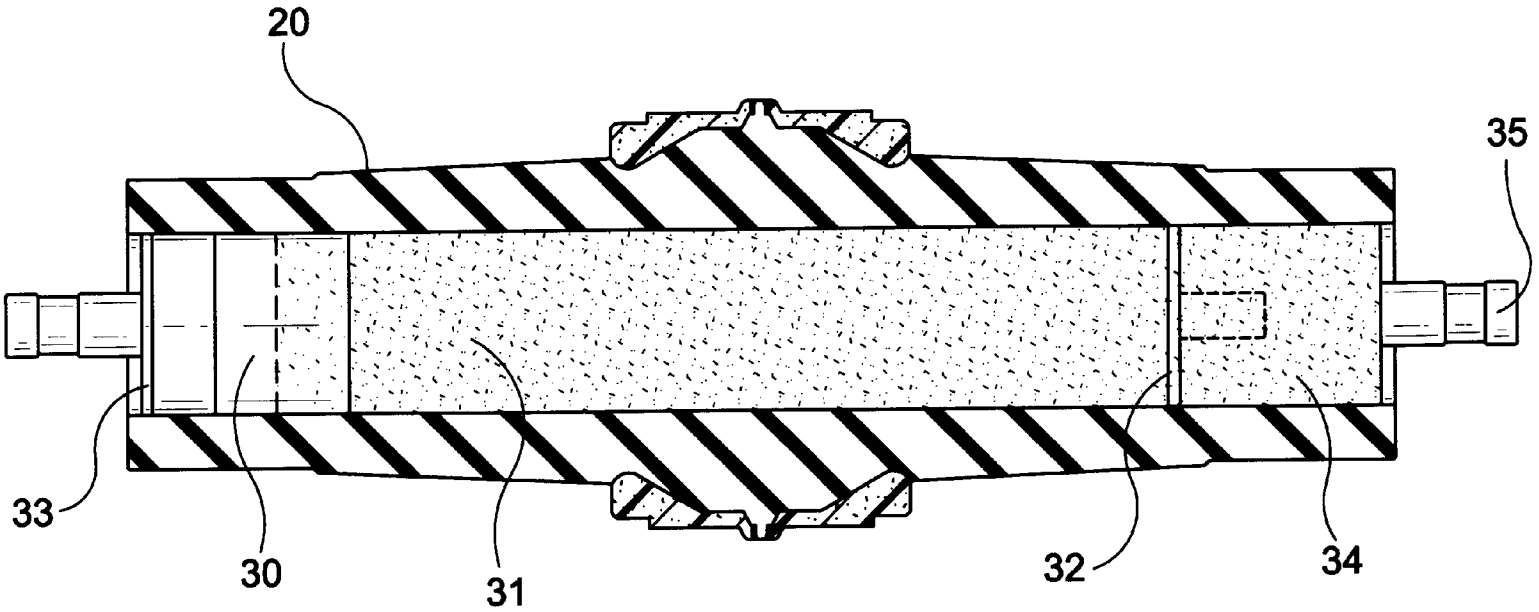
FIG. 4 is a partial cross-sectional view of the fuse housing formed in accordance with the present invention showing a smaller fuse and spacer.
Figure 5:
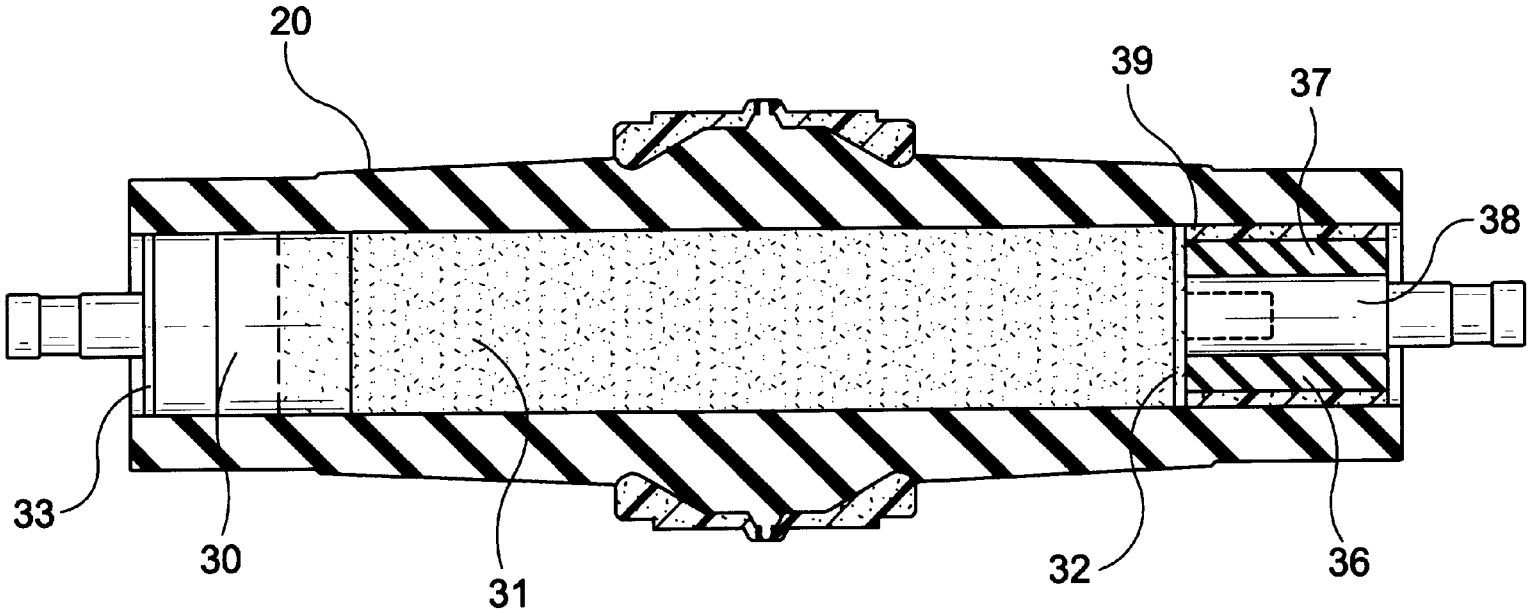
FIG. 5 is a partial cross-sectional view of the fuse housing showing an alternate embodiment of the spacer.

Referring now to FIGS. 4 and 5, a cross-section of an insulative fuse housing 20 is shown. The fuse housing 20 shown in FIGS. 4 and 5 is identical to that described above however a shorter length fuse 30 is encapsulated within the housing. The shorter fuse 30 is similarly coated or covered on its outer surface with an electrically conductive material 31 extending from one of the terminals 32 to a point just intermediate the other terminal 33.

In this case, however, a spacer 34 is provided as an extension to the fuse 30. The spacer 34 is generally shaped to fill the void in the fuse housing 20 left by the shorter length fuse 30. In a preferred embodiment of the spacer, as shown in FIG. 4, the spacer 34 is made of a solid lightweight electrically conductive material, such as aluminum, and is electrically coupled at one end to the fuse terminal 32 that is in contact with the conductive fuse coating 31. The other end of the spacer 34 includes a spacer terminal 35 which protrudes outwardly from the fuse housing 20 to act as a fuse terminal.

FIG. 5 shows an alternate embodiment of the spacer. Here, the spacer 36 includes an insulative body 37 and an electrically conductive terminal extension 38 disposed within the insulative body. The terminal extension 38 is electrically coupled to the fuse terminal 32 that is in contact with the conductive fuse coating 31. The terminal extension 38 extends outwardly from the spacer 34 and the fuse housing 20 for electrical connection to the voltage distribution system. Similar to the fuse 30, the outer surface of the spacer 38 is coated or covered with an electrically conductive material 39. When the spacer 38 is coupled to the fuse terminal 32 the conductive spacer coating 39 is in electrical contact with the conductive fuse coating 31 providing a continuous corona shield around the fuse 30 and the conductive terminal extension 36.

In both spacer embodiments, the portion of the spacer terminal 35 or terminal extension 38 protruding out of the fuse housing 20 is shielded by a conductive insert 24 or 25 as described above. Thus, any length fuse may be used with the present invention by providing a correspondingly sized spacer.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An encapsulated fuse assembly comprising:

an insulative housing having an axial bore therethrough a fuse disposed within said axial bore, said fuse including an elongated fuse body having longitudinally opposed ends and a contact terminal adjacent each end, wherein said elongated fuse body is substantially coated with an electrically conductive material, such that the conductive material is in electrical communication with one fuse terminal and extends along said body terminating intermediate the other fuse terminal and is not in electrical communication with said terminal, thereby leaving a portion of said body uncoated.

2. The encapsulated fuse assembly as defined in claim 1, wherein the insulative housing includes an electrically conductive jacket therearound.

3. The encapsulated fuse assembly as defined in claim 1, wherein the insulative housing includes an electrically conductive insert therein, said insert being in electrical communication with and substantially enveloping the fuse terminal adjacent the uncoated portion of said fuse body.

4. The encapsulated fuse assembly as defined in claim 1, wherein the insulative housing includes two electrically conductive inserts therein, each of said conductive inserts being in electrical communication with and substantially enveloping a terminal of the fuse.

5. The encapsulated fuse assembly as defined in claim 4, wherein the insulative housing comprises a fuse housing and two end housings, the fuse being disposed within said fuse housing and the electrically conductive inserts being disposed within said end housings.

6. The encapsulated fuse assembly as defined in claim 5, wherein the fuse housing and the end housings include electrically conductive jackets therearound.

7. The encapsulated fuse assembly as defined in claim 1, wherein the terminating point of the conductive material is coated with an insulating varnish.

8. The encapsulated fuse assembly as defined in claim 1, wherein the uncoated portion of the fuse is at least approximately 1.5 to 2 inches in length.

9. The encapsulated fuse assembly as defined in claim 1, wherein the fuse is replaceably disposed within the axial bore.

10. A high voltage fuse comprising: an elongated fuse body having longitudinally opposed ends; and a contact terminal adjacent each end, wherein said elongated fuse body is substantially covered with an electrically conductive material such that the conductive material is in electrical communication with one fuse terminal and extends along the fuse body terminating intermediate the other fuse terminal and is not in electrical communication with said terminal, thereby leaving a portion of said fuse body uncoated.

11. The fuse as defined in claim 10, wherein the terminating point of the conductive material is coated with an insulating varnish.

12. The fuse as defined in claim 10, wherein the uncoated portion of the body is at least approximately 1.5 to 2 inches in length.

13. In combination, a fuse and an insulative housing, said fuse including an elongated fuse body having longitudinally opposed ends and a contact terminal adjacent each end, wherein said elongated fuse body is substantially coated with an electrically conductive material such that the conductive material is in electrical communication with one fuse terminal and extends along the fuse body terminating intermediate the other fuse terminal and is not in electrical communication with said terminal, thereby leaving a portion of said fuse body uncoated; and said insulative housing encapsulating said fuse and having at least one electrically conductive insert disposed therein, said insert being in electrical communication with and substantially enveloping a terminal of said fuse.

14. The combination of claim 13, wherein the insulative housing includes an electrically conductive jacket therearound.

15. The combination of claim 13, wherein the insulative housing comprises a fuse housing and two end housings, the fuse being disposed within said fuse housing and an electrically conductive insert being disposed within each said end housing.

16. The combination of claim 13, wherein the fuse housing and the end housings include electrically conductive jackets therearound.

17. The combination of claim 13, wherein the terminating point of the conductive material is coated with an insulating varnish.

18. The combination of claim 13, wherein the uncoated portion of the fuse body is at least approximately 1.5 to 2 inches in length.

19. The encapsulated fuse assembly as defined in claim 1, further comprising a fuse spacer disposed within the axial bore along with the fuse, said spacer having a coupling end for electrically coupling to the fuse terminal in contact with the conductive fuse body coating and a terminal end.

20. The encapsulated fuse assembly as defined in claim 1, further comprising a fuse spacer disposed within the axial bore along with the fuse, said spacer including an insulative body and a conductive terminal extension disposed therein, said terminal extension having a coupling end for electrically coupling to the fuse terminal in contact with the conductive fuse body coating and a terminal end, said insulative body including an electrically conductive coating, and wherein said spacer coating is in electrical communication with the fuse body coating when said spacer is coupled to the fuse.

21. The encapsulated fuse assembly as defined in claim 19, wherein the insulative housing includes two electrically conductive inserts therein, one of said conductive inserts being in electrical communication with and substantially enveloping the fuse terminal adjacent the uncoated portion of the fuse body and the other of said inserts being in electrical communication with and substantially enveloping the terminal end of the fuse spacer.

22. The encapsulated fuse assembly as defined in claim 20, wherein the insulative housing includes two electrically conductive inserts therein, one of said conductive inserts being in electrical communication with and substantially enveloping the fuse terminal adjacent the uncoated portion of the fuse body and the other of said inserts being in electrical communication with and substantially enveloping the terminal end of the terminal extension of the fuse spacer.

* * * * *